US010712125B2

(12) United States Patent
Willard

(10) Patent No.: US 10,712,125 B2
(45) Date of Patent: Jul. 14, 2020

(54) WEAPON RESTRAINT SYSTEM

(71) Applicant: Derrick Willard, Macon, GA (US)

(72) Inventor: Derrick Willard, Macon, GA (US)

( * ) Notice: Subject to any disclaimer, the term of this patent is extended or adjusted under 35 U.S.C. 154(b) by 556 days.

(21) Appl. No.: 15/360,890

(22) Filed: Nov. 23, 2016

(65) Prior Publication Data

US 2017/0146316 A1 May 25, 2017

Related U.S. Application Data

(60) Provisional application No. 62/291,824, filed on Feb. 5, 2016, provisional application No. 62/259,309, filed on Nov. 24, 2015.

(51) Int. Cl.

| | |
|---|---|
| ***F41C 33/00*** | (2006.01) |
| ***A45F 5/00*** | (2006.01) |
| ***A45F 3/06*** | (2006.01) |
| ***A45F 3/14*** | (2006.01) |
| ***B65H 75/40*** | (2006.01) |
| ***B65H 59/04*** | (2006.01) |
| ***B65H 75/44*** | (2006.01) |
| ***A41D 13/00*** | (2006.01) |
| ***F41C 33/04*** | (2006.01) |

(52) U.S. Cl.

CPC ..... *F41C 33/007* (2013.01); *A45F 3/06* (2013.01); *A45F 3/14* (2013.01); *A45F 5/004* (2013.01); *B65H 59/04* (2013.01); *B65H 75/40* (2013.01); *B65H 75/4418* (2013.01); *B65H 75/4436* (2013.01); *A41D 13/0007* (2013.01); *A41D 2400/46* (2013.01); *A45F 2003/142* (2013.01); *A45F 2200/0591* (2013.01); *B65H 2701/35* (2013.01); *F41C 33/046* (2013.01)

(58) Field of Classification Search

CPC ..... A45F 5/004; A45F 2005/006; A45F 2005/008; B65H 75/28; B65H 75/4402; B65H 75/446; B65H 75/4471; B65H 75/48; B65H 2701/35

See application file for complete search history.

(56) References Cited

U.S. PATENT DOCUMENTS

| | | | | |
|---|---|---|---|---|
| 1,663,766 A * | 3/1928 | Landis | B65H 75/406 | 224/162 |
| 1,675,072 A * | 6/1928 | Watermon | A41D 13/04 | 2/48 |
| 2,793,617 A * | 5/1957 | Palmer | B43K 23/001 | 224/162 |
| 4,145,028 A * | 3/1979 | Kelley | B66D 1/00 | 224/263 |
| 4,877,167 A * | 10/1989 | McNemar | A45F 5/02 | 224/269 |

(Continued)

*Primary Examiner* — William A. Rivera

(74) *Attorney, Agent, or Firm* — Clayton, McKay & Bailey, PC

(57) ABSTRACT

A wearable weapon restraint system is provided. The system includes a cable having a proximal end and a distal end, a retractable cable reel configured to contain the cable and allow the cable to extend and/or retract relative to the retractable cable reel, and a conduit having a passageway extending along at least a portion of the conduit. The cable can be positioned such that at least a portion of the cable passes through the passageway of the conduit. The distal end of the cable can be coupled to a fastening device.

17 Claims, 5 Drawing Sheets

(56) References Cited

U.S. PATENT DOCUMENTS

| | | | | |
|---|---|---|---|---|
| 5,009,022 | A * | 4/1991 | McCoy | F41C 33/001 42/106 |
| 8,418,898 | B2 * | 4/2013 | Carlsson | A45F 3/14 224/162 |
| 9,089,124 | B1 * | 7/2015 | Cox | A01M 31/06 |
| 9,629,446 | B2 * | 4/2017 | Moreau | A45F 5/004 |
| 2012/0168472 | A1 * | 7/2012 | Mathews | A45F 3/14 224/162 |
| 2015/0375021 | A1 * | 12/2015 | Kozuki | A62B 35/0075 182/231 |
| 2017/0079414 | A1 * | 3/2017 | Moreau | A45F 5/004 |

* cited by examiner

WEAPON RESTRAINT SYSTEM

PRIORITY INFORMATION

This application claims priority to U.S. Provisional Patent Application No. 62/259,309, filed Nov. 24, 2015, and U.S. Provisional Patent Application No. 62/291,824, filed Feb. 5, 2016, both of which are hereby incorporated by reference in their entireties.

FIELD OF THE EMBODIMENTS

The embodiments herein relate generally to a weapon restraint system and methods for using the same. More specifically, the embodiments relate to a weapon restraint system that allows a user to safely carry a weapon in a manner that allows for maximum flexibility without negatively impacting any desired use of the weapon.

BACKGROUND

Many U.S. military personnel carry rifles or other large weapons from time to time as part of their military duties. Typically, the U.S. government provides these personnel with an outdated shoulder sling—similar to those used in World War II—for carrying their weapon. Many military personnel immediately replace the outdated sling with a more modern aftermarket version. However, today's weapon slings share a number of significant drawbacks and limitations.

A conventional sling attaches to a weapon at one point or more points and is designed primarily for retention purposes. While these slings can provide adequate weapon retention, they have many drawbacks. For example, the sling only allows for a one-handed configuration when handling the weapon, requiring the user to remove the sling and reinstall it on the other shoulder to switch firing hands. The sling also allows the weapon to swing or move around on the user's body as they perform athletic activities such as walking, running, jumping, or climbing. Even the simple act of kneeling or squatting down may result in the tip of the weapon contacting the ground, risking weapon damage or malfunction from debris.

Furthermore, when a user wants to switch to a secondary weapon, the weapon connected to the sling must be physically thrown, or slung, behind the user to get it out of the way. Retrieving the weapon requires the user to either reach behind them for the gun or rotate the sling around their shoulder, wasting precious time and energy. Additionally, the conventional sling is not well suited to long periods of use. Large guns can be quite heavy, especially when fully loaded, and conventional slings concentrate that weight on the user's body. This causes fatigue that can lead to other operational hazards.

Therefore, a need exists for an improved weapon restraint system, and in particular, a weapon restraint system that allows a user to safely carry a weapon in a manner that allows for maximum flexibility without negatively impacting any desired use of the weapon.

SUMMARY

Embodiments described herein include a weapon restraint system and methods for using the same. In one embodiment, a wearable weapon restraint system is provided. The system includes a cable having a proximal end and a distal end, a retractable cable reel configured to contain the cable and allow the cable to extend and/or retract relative to the retractable cable reel, and a conduit having a passageway extending along at least a portion of the conduit. The cable can be positioned such that at least a portion of the cable passes through the passageway of the conduit. The distal end of the cable can be coupled to a fastening device.

The fastening device of the system can be configured such that it may be removably coupled to at least one of a weapon, tool, or other object to be carried by a user. The system can also include a supplemental restraint device that can support a portion of the weapon, tool, or object. For example, the supplemental restraint device can include a strap having at least one magnet. When the magnet is coupled to a magnetic object, the strap can form a loop that supports a portion of the weapon, tool, or object. In the example of a rifle, the supplemental restraint device can secure a portion of the rifle barrel. In some examples, the supplemental restraint device can include a handle that, when pulled, decouples the magnet and releases the previously secured portion of the weapon, tool, or object.

The retractable cable reel may include a spring that maintains tension on the cable. Along those lines, the retractable cable reel can be configured to provide one of several different tension levels on the cable. In addition, the retractable cable reel can include a tension selection mechanism for selecting between the different tension levels. Each of the different tension levels may correspond to a particular category of weapon, tool, or other object. The tension selection mechanism can be, for example, a knob, switch, dial, or button.

The conduit of the weapon restraint system can be positioned such that, when the weapon restraint system is worn by a user, at least a portion of the conduit passes over a shoulder of the user. A guide device can be used to maintain a position of at least one of the cable, conduit, or fastening device relative to the user. The guide device prevents at least one of the fastening device or distal end of the cable from retracting through the guide device. The system may provide more than one guide device. For example, two guide devices can be configured to position at least a portion of the conduit such that the conduit passes over either the left or right shoulder, respectively, of the user.

The weapon restraint system can also include a chassis configured to be worn by the user. The chassis can be used to store the retractable cable reel. The chassis can also include a chest plate having a guide device configured to maintain a position of at least one of the cable, conduit, or fastening device relative to the chest plate. The chassis can include at least one of a bag, a pack, a backpack, a vest, a shirt, a jacket, one or more straps, a chest plate, a substrate, a frame, or some combination thereof. The chassis can store the retractable cable reel in a storage container that includes an opening through which the cable and/or conduit can pass. The conduit can prevent the distal end of the cable from retracting through the passageway of the conduit.

A method is also provided for restraining a weapon, tool, or other object. The method includes providing a cable having a proximal end and a distal end, providing a retractable cable reel configured to contain the cable and allow the cable to extend and/or retract relative to the retractable cable reel, providing a conduit having a passageway extending along at least a portion of the conduit, positioning the cable such that at least a portion of the cable passes through the passageway of the conduit; coupling the distal end of the cable to a fastening device, and coupling the fastening device to the weapon, tool, or other object.

The method may include selecting a tension level for the retractable cable reel. It can also include positioning the cable and/or conduit such that the cable and/or conduit passes over a shoulder of a user.

The method can also include providing a supplemental restraint device heaving at least one magnet that, when coupled to a magnetic object, cause the supplemental restraint device to support at least a portion of the weapon, tool, or object. The method can also include coupling the magnet such that the supplemental restraint device provides support for at least a portion of the weapon, tool, or object. In the case of a rifle, for example, the method can include securing the barrel of the rifle via the supplemental restraint device.

Both the foregoing general description and the following detailed description are exemplary and explanatory only and are not intended to restrict the scope of the invention as claimed.

BRIEF DESCRIPTION OF THE DRAWINGS

The accompanying drawings, which are incorporated in and constitute a part of this disclosure, illustrate various embodiments and aspects of the present invention. In the drawings.

DETAILED DESCRIPTION

Reference will now be made in detail to the present exemplary embodiments, including examples illustrated in the accompanying drawings. Wherever possible, the same reference numbers will be used throughout the drawings to refer to the same or like parts.

Figure 1:
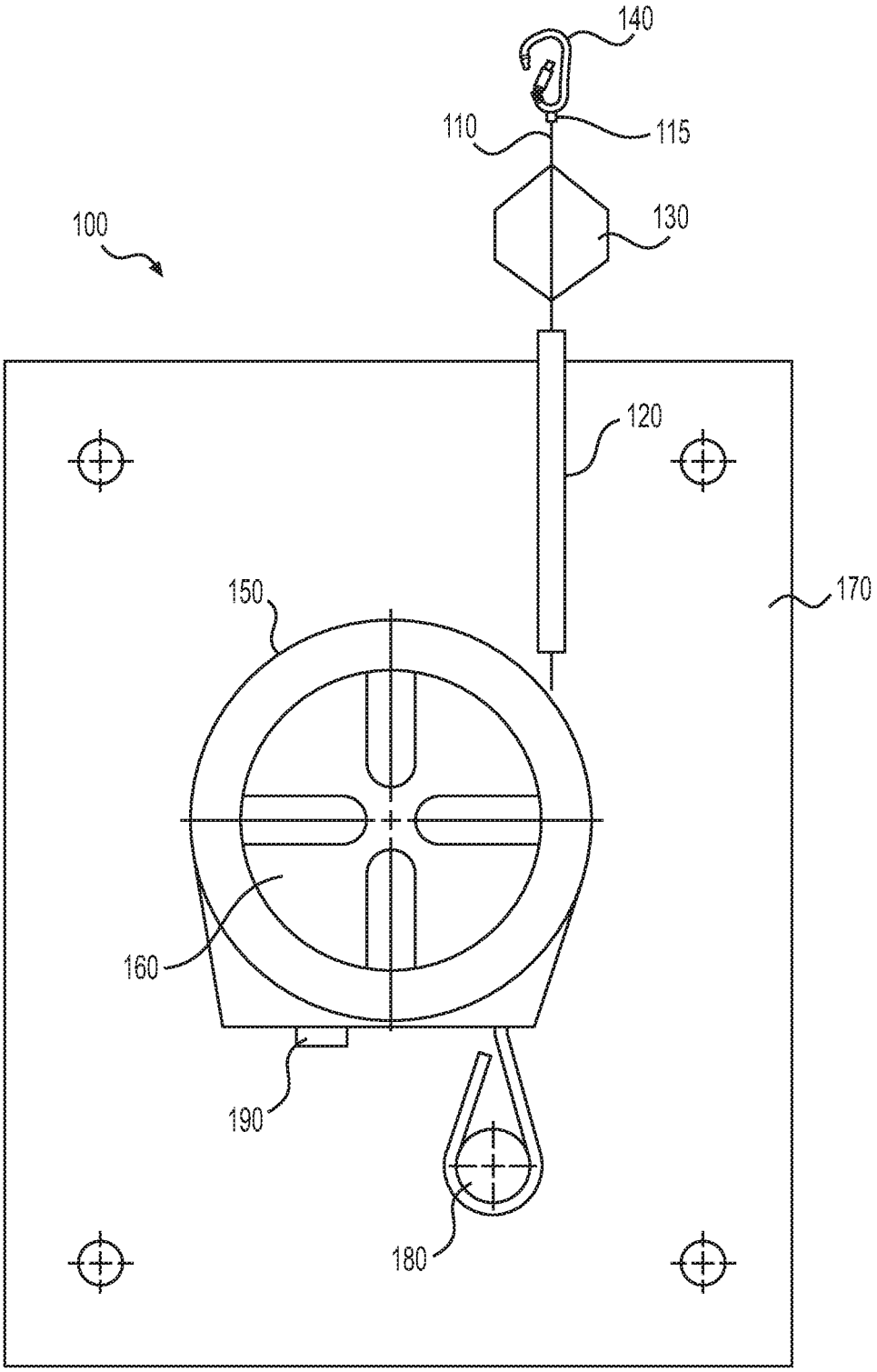
FIG. 1 is a diagram of an example embodiment of a wearable weapon restraint system including a retractable cable reel and conduit.

FIG. 1 provides a diagram of an example embodiment of a wearable weapon restraint system 100. The wearable weapon restraint system 100 includes a retractable cable reel 150 which, in this particular example, is mounted to a support platform 170. Support platform 170 may allow for the weapon restraint system 100 to be installed in or on various enclosures or other objects. For example, the support platform 170 can be mounted inside a backpack or other enclosure. As another example, the support platform 170 can be mounted on a vest, shirt, jacket, or other wearable item.

Alternatively, the retractable cable reel 150 can be secured directly to other items, such as a backpack or item of clothing, without the use of a support platform 170. The retractable cable reel 150 of FIG. 1 is also secured to a support post 180, which provides a base upon which the retractable cable reel 150 can counteract the forces inherent in pulling the cable from the retractable cable reel 150. For embodiments where the support platform 170 is not used, the support post 180 can be incorporated into the item upon which the retractable cable reel 150 is directly mounted—for example, a backpack or item of clothing.

The retractable cable reel 150 can be any type of reel that allows a cable to extend from, and retract back into, a reel. For example, a tool retractor may be used. An example tool retractor is the Hubbell Tool Retractor, Model No. BD-05. An example cable 110 length for the retractable cable reel 150 is about 6 feet, although a longer or shorter cable 110 may be used. The retractable cable reel 150 may be spring loaded, such that the retractable cable reel 150 imparts a tension force to the cable 110, causing the cable 110 to retract unless it the cable 110 is pulled at a tension greater than the tension imparted by the spring of the retractable cable reel 150.

The retractable cable reel 150 may have a single tension level or may utilize adjustable tension levels. In one embodiment, the retractable cable reel 150 is adjustable based on the type or size of object to be carried by the user. For example, the retractable cable reel 150 may include a tension selector 160 that allows a user to vary the tension of the reel. The tension selector 160 can be, for example, a switch, dial, knob, or button. The tension selector 160 may correspond to particular weapons based on their weight, with or without ammo. For example, the tension selector 160 may have a first setting for a standard rifle, a second setting with a relatively higher tension level for a large machine gun, and a third setting with an even higher relative tension level for a heavy object such as a battering ram.

Additionally, the retractable cable reel 150 can have a button 190 that functionally changes the operation of the retractable cable reel 150 when pressed. For example, the button 190 may lock the retractable cable reel 150 such that no tension is imparted to the cable 110 until the button 190 is pressed again. As another example, the button 190 may toggle a ratchet lock mechanism on or off.

FIG. 1 illustrates a cable 110 extending from the retractable cable reel 150. The cable 110 can be made from any material having sufficient strength, durability, and flexibility. Example materials include steel, nylon, Kevlar, and other metals, fibers, and polymers. At least a portion of the cable 110 is surrounded or encapsulated in a conduit 120. The conduit 120 shown in FIG. 1 is hollow throughout the length of the conduit 120, providing a passageway through which the cable 110 extends.

The conduit 120 can be sized and positioned such that it remains in a stable position relative to the retractable cable reel 150, while the cable 110 is allowed to move unhindered through the conduit 120. The conduit 120 can be routed to a desired location, such as a location in the vicinity of a user's chest. For example, the conduit 120 can extend over the user's shoulder. By using the conduit 120, the cable 110 is allowed to extend and retract over the user's shoulder without catching or rubbing the user's shirt, skin, or other objects in the area of the conduit 120.

Any type of conduit 120 may be used; for example, the conduit 120 may be a rigid, pliant, or curved pipe, tube, or sleeve. The conduit 120 can be a single integrated conduit or it can comprise a plurality of conduits either coupled to one another or positioned substantially adjacent to one another.

The conduit 120 can be made from any suitable material, such as plastic, rubber, stainless steel, Kevlar, or other material that can withstand the friction of a cable passing within. Ideally, the material for the conduit 120 is selected to match the material for the cable 110, such that the friction of the cable 110 sliding within the conduit 120 does not produce excess heat or wear on the components. Existing combinations of cables and conduits may be used—for example, various cables having conduits are used for automotive purposes, such as brake cables, clutch cables, and throttle cables.

The cable 110 may pass through, or otherwise connect to, a stopper 130. Stopper 130 is intended to prevent the cable from retracting beyond a certain point. In some embodiments, the conduit 120 is coupled to the stopper 130, while the cable 110 is allows to pass through the stopper 130. The distal end 115 of the cable 110 can be coupled to an object that is too large to fit through the stopper 130, thereby preventing the cable from retracting beyond that point. In other embodiments, the cable 110 is coupled directly to the stopper 130. For example, in the embodiment of FIG. 1, the distal end 115 of the cable 110 is coupled to a fastening device 140. In either scenario, the stopper 130 can control the amount of cable 110 that can be retracted into the retractable cable reel 150. For example, the stopper 130 may abut an enclosure of guide device that prevents the stopper 130 from traveling further. This concept is discussed in more detail with respect to FIG. 2A. In other examples, the stopper 130 may abut the conduit 120 itself.

The distal end 115 of the cable 110 may be coupled to a fastening device 140. In other embodiments, the distal end 115 of the cable 110 is coupled to the stopper 130, which is in turn coupled to the fastening device 140. The fastening device 140 can be any device that can attach to an object. A typical example of a fastening device 140 is a carabiner. Carabiners are metal loops with a spring-loaded gate that allows for quick connection and disconnection to objects. A screw-style carabiner is another example, providing additional security by locking the spring-loaded gate after it has been closed.

However, the fastening device 140 disclosed herein is not limited to a carabiner; rather, any device that secures the cable 110 to an object, such as a weapon, may be used. In some embodiments the object includes a loop, hook, or handle designed to be engaged by the fastening device 140. For example, in the case of a rifle, the body of the rifle may provide several loops, hooks, or handles at various locations, allowing the user to choose how to fasten the weapon to the fastening device 140.

Figure 2A:
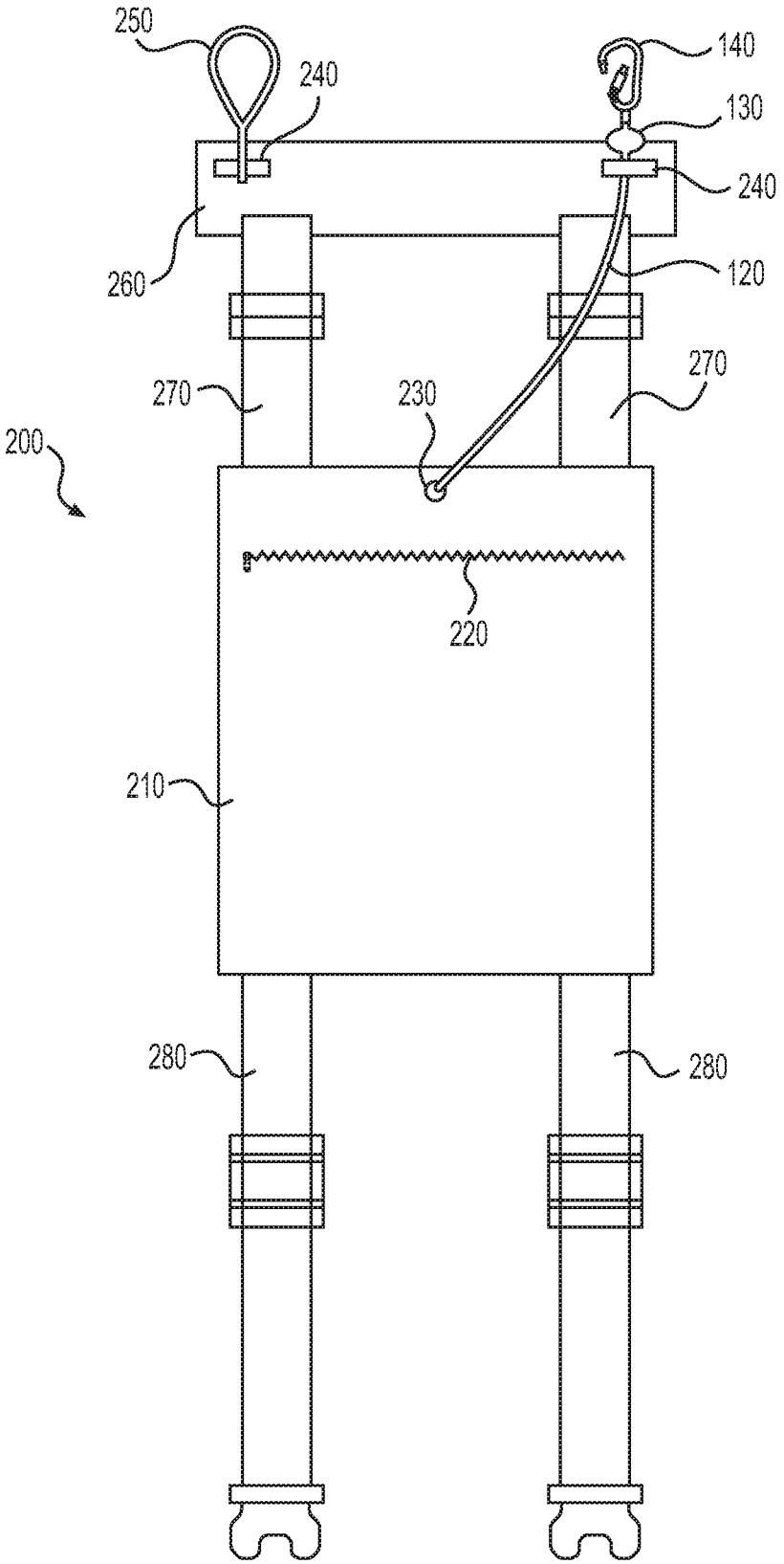
FIG. 2A is an illustration of an example embodiment of a wearable weapon restraint system including a chassis, retractable cable, and a supplemental restraint device.

FIG. 2A provides an illustration of an example embodiment of a wearable weapon restraint system 100 including various components. For example, FIG. 2A shows a chassis 200 configured to be worn by a user. The chassis 200 includes a storage container 210 that may house the retractable cable reel 150. For example, the retractable cable reel 150 may be installed in the storage container 210 with or without its support platform 170. A zipper 220 may be provided on the storage container 210 to allow access to the retractable cable reel 150. Other types of enclosures may be used in lieu of a zipper, including for example clasps, buttons, or clips.

The storage container 210 provides for convenient storage of the retractable cable reel 150 while also protecting the retractable cable reel 150 from dirt and debris. The storage container 210 may also be made from a protective material, such as a plastic, polymer, metal, or carbon fiber material, in order to protect the retractable cable reel 150 from impacts, gunshots, shrapnel, and so on.

Regardless of its shape or form, the storage container 210 may have an opening 230 to allow the cable 110 and/or conduit 120 to extend from the storage container 210. The opening 230 may be a slot, hole, or other aperture sized to fit the cable 110 or conduit 120 as needed.

From there, the cable 110 or conduit 120 is routed toward a chest plate 260. The chest plate 260 can be coupled to the storage container 210 via shoulder straps 270. The shoulder straps 270 may be constructed from a pliable yet strong material, such as nylon or Kevlar, and may be adjustable such that the user can adjust the positioning of the chest plate and/or storage container 210. When the weapon restraint system 100 is worn by a user, the shoulder straps 270 can extend over the user's shoulders, providing a mechanism to support the weight of the weapon restraint system 100.

Similar to the manner in which the shoulder straps 270 extend over a user's shoulders, the cable 110 can be routed such that it extends over either of the user's shoulders. In the embodiment of FIG. 2A, the cable 110 and conduit 120 are routed such that they would extend over the user's right shoulder. In such embodiments, the user's shoulder can act as a leverage point (similar to a pulley) to help support the weight of a weapon, tool, or object coupled to the distal end 115 of the cable 110. The system 100 can be ambidextrous such that the conduit can be configured to pass over either the left or right shoulder of the user. For example, a right-handed user may prefer the conduit 120 to pass over his or her right shoulder, while a left-handed user may prefer the conduit 120 to pass over his or her left shoulder.

In order to keep the cable 110 oriented in a desired position, one or more guide devices 240 may be positioned along a desired path of the cable 110 and/or conduit 120. The guide devices 240 can be used to maintain the positioning of the conduit 120 and the cable 110 and/or secure or retain the distal end of the conduit 120 or cable 115. The cable 110 can extend through (or otherwise be coupled or retained by) the guide devices 240.

In the embodiment of FIG. 2A, the conduit 120 extends through the guide device 240 on the right side of the chest plate 260. The guide device 240 retains the cable 110 by abutting the stopper 130. Additional guide devices 240 may be used along the shoulder straps 270 to position other portions of the cable 110 and conduit 120 as desired.

FIG. 2A also shows a supplemental restraint device 250 coupled to a guide device 240 that is located on the left side of the chest plate 260, opposite the guide device 240 used to restrain the cable 110 and conduit 120. The supplemental restraint device 250 may be any device configured to couple to a portion of the weapon, tool, or object being carried by the user. The primary method of fastening the weapon, tool, or object is via the fastening device 140. However, at certain times, the user may wish to restrain the weapon at two locations rather than one. For example, the user may wish to climb a ladder, sprint, or do detailed work with both hands, and may want their weapon, tool, or object in a particular orientation during those tasks. At these times the user can take advantage of the supplemental restraint device 250, for example by inserting the barrel of a rifle through the supplemental restraint device 250.

Because the supplemental restraint device 250 is not the primary means of restraint, it need not be as robust a fastening mechanism as the fastening device 140. Instead, it may be a strap, loop, Velcro strip, or other hook or clip type mechanism. Of course, a carabiner or locking fastener may be used as well if desired. The supplemental restraint device 250 may be used on either guide device 240, or may be attached elsewhere on the weapon restraint system 100 or otherwise on the user's body.

The chassis 200 may also include back straps 280. The back straps 280 can each attach at one end to the storage container 210 or directly to the retractable cable reel 150, and attach at the other end to the chest plate 260. By attaching the chest plate to the storage container 210 or retractable cable reel 150 via straps that go both over and under the user's arms, the chest plate 260, storage container 210, and retractable cable reel 150 can securely stay in a desired location on the user, even when the user is performing athletic activities such as running, jumping, and climbing. The back straps 280 may attach to the chest plate 260 in either a permanent or removable fashion.

Although a chest plate is depicted in FIG. 2A, embodiments are contemplated that do not include a chest plate. For example, in one embodiment the conduit 120 is routed through a plurality of rings, such as metal D-rings, attached to a shoulder strap. The rings can be sized such that the stopper 130 is too large to pass through the ring, causing the cable 110 to be positioned as desired. Similarly, a supplemental restraint device 250 can be attached to rings disposed on an opposing shoulder strap. The shoulder straps can be part of a backpack or bag that the user carries. The shoulder straps can include an optional securing mechanism, such as a small strap with a buckle, that prevent the shoulder straps from spreading too far from one another. In another embodiment, the design of the backpack can cause the shoulder straps to securely stay at one location on the user's body, eliminating the need for a chest plate or other securing mechanism.

Accordingly, any references to a chest plate in this disclosure are intended to encompass an alternative embodiment utilizing shoulder straps, such as the straps of a backpack. Any components attached to a chest plate can alternatively be attached to one or more shoulder straps. Similarly, any functionality of the chest plate can be carried out by other components, such as shoulder straps and any related securing mechanisms.

Figure 2B:
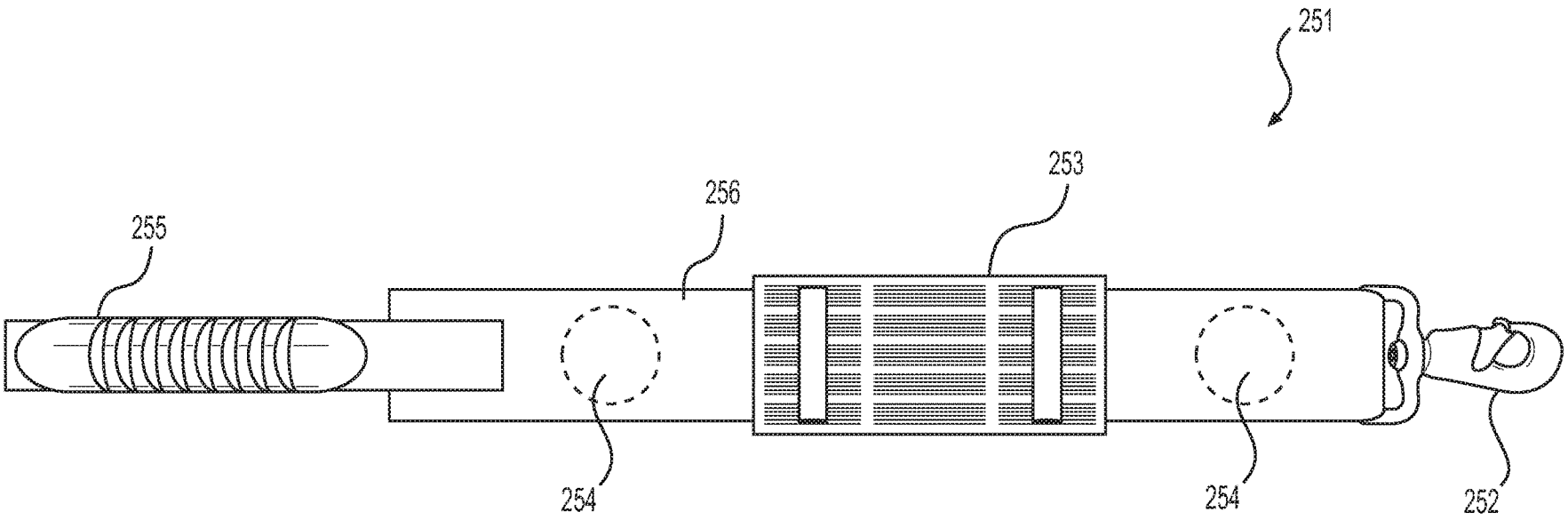
FIG. 2B is an illustration of an example embodiment of a supplemental restraint device.

FIG. 2B provides an illustration of an example embodiment of a supplemental restraint device 251 that can replace or supplement the restraint device 250 described with respect to FIG. 2A. The supplemental restraint device 251 of FIG. 2B can provide supplemental restraint to a weapon, tool, or object being carried by the user. The supplemental restraint device 251 can be coupled to a guide device located on a chest plate 260, shoulder strap, or chassis. The supplemental restraint device 251 can be coupled to a guide device using a fastening device 252. In the example embodiment of FIG. 2B, the fastening device 252 is a hook with a safety catch. This type of design allows a user to quickly fasten the supplemental restraint device 251 to a secure guide device while preventing the fastening device 252 from being unfastened.

The fastening device 252 of the supplemental restraint device 251 can include a D-ring, or other suitable attachment mechanism, for attaching the fastening device 252 to a strap 256. The strap 256 can be made from a flexible but resilient material such as nylon, Kevlar, fiber, polymer, or some combination thereof. The strap 256 can be coupled to a strap pad 253. In some examples, the strap pad 253 is made from a more resilient material than the strap 256. This is because, in some examples, the strap pad 253 can come into contact with high-temperature material, such as the barrel of a rifle which has recently discharged multiple rounds of ammunition. The strap pad 253 can therefore be made from a resilient material, such as nylon, Kevlar, fiber, polymer, or some combination thereof. In some examples, the strap pad 253 includes at least some flexibility, such that the strap pad 253 can at least partially wrap around a weapon, tool, or object.

In one example, the strap 256 of the supplemental restraint device 251 can include one or more magnets 254. The example of FIG. 2B shows two magnets 254 sewn into the strap 256 of the supplemental restraint device 251. The magnets 254 can be attached in other ways, such as by gluing them to the strap 256 or enclosing them in a pocket of the strap 256. In some examples, one magnet 254 is used in conjunction with a magnetized fastening device 252. In another example, one magnet 254 is included in the strap 256 and another magnet 254 is positioned on a shoulder strap, chest plate, chassis, or other device worn by the user. In either case, coupling the magnets 254 to one another can cause the supplemental restraint device 251 to form a loop, partially enclosing a weapon, tool, or object with the strap pad 253. Although magnets 254 are shown in FIG. 2B, in some examples the magnets 254 can be replaced by other couplings, such as a button or press-fit coupling. The supplemental restraint device 251 can include a handle 255 attached to the strap 256. The handle 255 can assist a user with decoupling the magnets 254 from one another to release the portion of the weapon, tool, or object being restrained by the supplemental restraint device 251.

When the fastening device 252 is attached to the user and the magnets 254 are not coupled to one another, or to another magnetic object, the supplemental restraint device 251 can hang freely without impeding the use of a weapon, tool, or object connected to the cable 110. When the user chooses to secure the weapon, tool, or object, the user can place a portion of the weapon, tool, or object near the strap pad 253 of the supplemental restraint device 251. The user can then manually lift the portion of the supplemental restraint device 251 including the handle 255 such that the magnets 254 couple to one another, or to another magnetic object. As a result, a portion of the weapon, tool, or object will be supported and restrained by the supplemental restraint device 251.

When the user chooses to release the weapon, tool, or object from the supplemental restraint device 251, the user can pull the handle 255 in a direction away from the user's body and/or toward the ground. The force from pulling the handle 255 can cause the magnets 254 to decouple, opening the supplemental restraint device 251 and allowing the previously secured portion of the weapon, tool, or object to be accessed. This feature can be particularly useful when the user requires rapid use of the weapon, tool, or object. For example, in a military scenario, a user may need to access a rifle as quickly as possible. The barrel of the rifle can be supported by the supplemental restraint device 251, as explained above. To use the rifle, the user can simply pull down on the handle and point the rifle as desired. Similar steps can be taken with respect to other weapons, tools, or objects.

Figure 3:
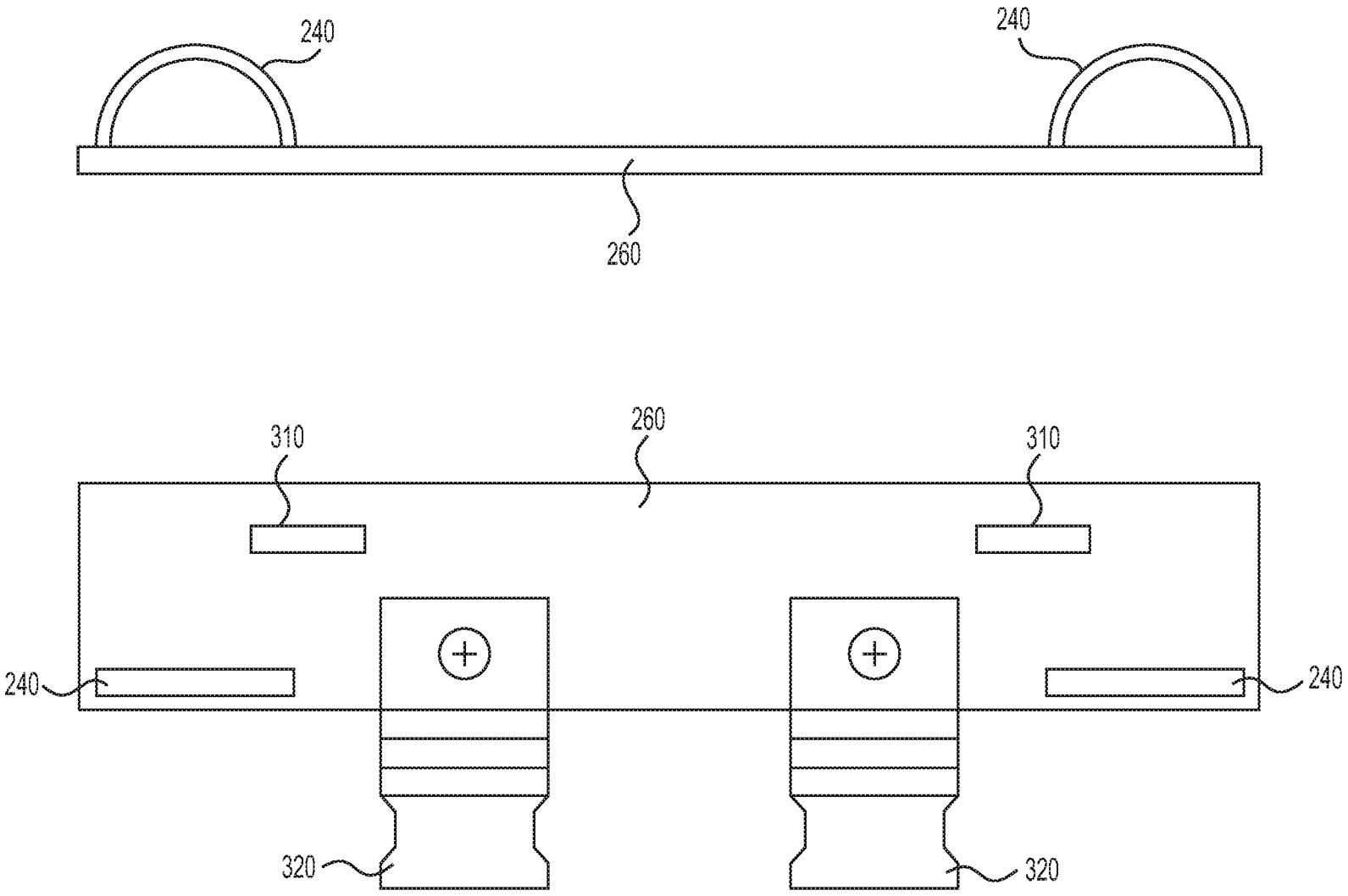
FIG. 3 is a diagram of an example embodiment of a chest plate having a plurality of guide devices.

FIG. 3 provides a diagram of an example embodiment of a chest plate 260 having two strap buckles 320. The strap buckles 320 can be mounted to the chest plate 260 and provide a mechanism for removably coupling the back straps 280 to the chest plate 260. Other coupling mechanisms may be used as well, such as clips, hooks, or ties. Additionally, a single strap buckle 320 may be used to couple to the back straps 280. Finally, the strap buckles 320 may be placed at locations other than the chest plate 260, such as on shoulder straps 270.

FIG. 3 also shows connection points 310 on the chest plate 260. Connection points 310 can be used to couple shoulder straps 270 to the chest plate 260. Connection points 310 may be apertures in chest plate 260 through which the shoulder straps 270 wrap around or through. This type of connection may be useful because the user may not need to disconnect the chest plate 260 from the shoulder straps 270 (instead disconnecting the chest plate 260 from the back straps 280 to remove the weapon restraint system 100).

However, the coupling mechanisms described with respect to the strap buckles 320 can similarly be used for connection points 310, and vice versa.

Figure 4:
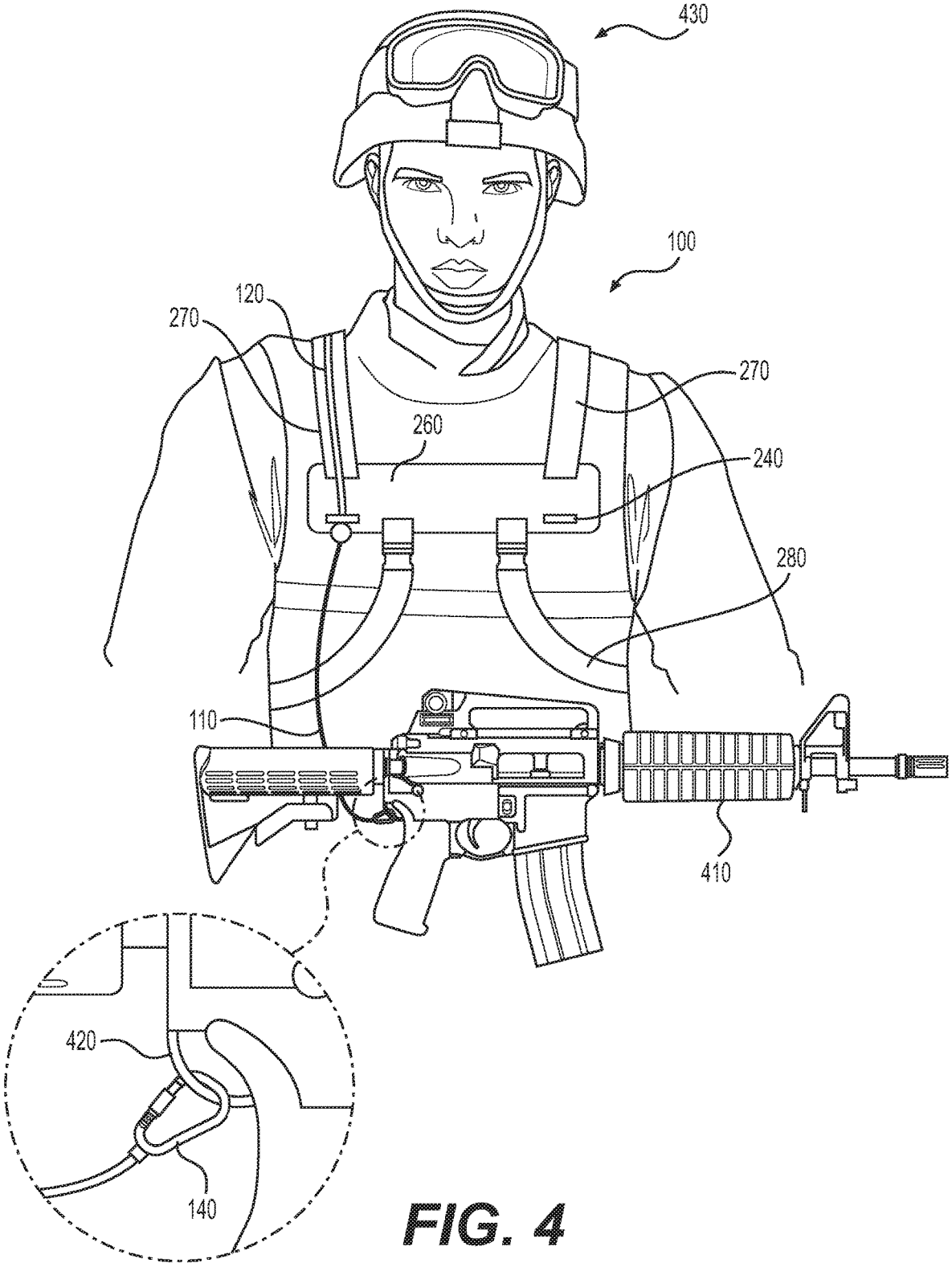
FIG. 4 is an illustration of an example embodiment of a user wearing a weapon restraint system connected to a weapon.

FIG. 4 provides an illustration of a user wearing an example weapon restraint system connected to a weapon. In particular, user 430 is shown wearing weapon restraint system 100. As shown in the drawing, the conduit 210 is routed over the user's 430 right shoulder, along the shoulder strap 270, to the guide device 240 on the user's 430 right side of the chest plate 260. A weapon 410 is connected to the cable 110 via fastening device 140, which is attached to the weapon 410 at attachment loop 420. The weapon 410 is shown in a position that has extended the cable 110, presumably due to the user 430 holding the weapon in that location. If the user 430 were to release the weapon, the cable 110 would retract until the fastening device 140 abuts the stopper 130.

Although a weapon 410 is shown in use with the weapon restraint system 100, other objects may be used as well. For example, the system 100 may be used to carry tools, backpacks, ammunition, equipment, or any other object that lends itself to being fastened to the fastening device 140 and carried by a user 430.

Furthermore, although the weapon restraint system 100 has been depicted in the figures as an external system that can be worn on top of a user's clothing, the system may additionally be incorporated into a wearable item. For example, the conduit 120 may be sewn into a shirt or vest, in a position that extends over the user's shoulder(s). Similarly, the chest plate 260 may be inserted into an item of clothing. In some embodiments, the chest plate 260 is substituted with a portion of a wearable item, such as a Kevlar patch sewn into the chest of a shirt or vest. The remaining elements of FIGS. 1-4 can similarly be adapted for incorporation into a wearable item, and the disclosure herein intends to fully cover such implementations.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A wearable weapon restraint system, comprising:

a cable having a proximal end and a distal end;

a retractable cable reel configured to contain the cable and allow the cable to extend and/or retract relative to the retractable cable reel;

a conduit having a passageway extending along at least a portion of the conduit, wherein the cable is positioned such that at least a portion of the cable passes through the passageway of the conduit, and wherein the distal end of the cable is coupled to a fastening device configured to be removably coupled to at least one of a weapon, tool, or other object; and a supplemental restraint device comprising a strap and at least one magnet such that a first portion of the strap can be magnetically coupled to a second portion of the strap to, provide supplemental restraint to the weapon, tool, or other object.

2. The weapon restraint system of claim 1, wherein the supplemental restraint device comprises a handle that, when pulled, releases the supplemental restraint device from the weapon, tool, or object.

3. The weapon restraint system of claim 1, wherein the retractable cable reel comprises a spring that maintains tension on the cable.

4. The weapon restraint system of claim 3, wherein the retractable cable reel is configured to provide one of a plurality of tension levels on the cable.

5. The weapon restraint system of claim 4, wherein the retractable cable reel comprises a tension selection mechanism for selecting between the plurality of tension levels, wherein each of the plurality of tension levels corresponds to a particular category of weapon, tool, or other object.

6. The weapon restraint system of claim 1, wherein the conduit is positioned such that, when the weapon restraint system is worn by a user, at least a portion of the conduit passes over a shoulder of the user.

7. The weapon restraint system of claim 1, further comprising a guide device configured to maintain a position of at least one of the cable, conduit, or fastening device relative to the user.

8. The weapon restraint system of claim 7, wherein the guide device prevents at least one of the fastening device or distal end of the cable from retracting through the guide device.

9. The weapon restraint system of claim 7, further comprising a plurality of guide devices, wherein at least two of the plurality of guide devices are configured to position at least a portion of the conduit such that the conduit passes over either the left or right shoulder, respectively, of the user.

10. The weapon restraint system of claim 1, further comprising a chassis configured to be worn by the user, wherein the chassis is further configured to store the retractable cable reel.

11. The weapon restraint system of claim 10, wherein the chassis comprises at least one of a bag, a pack, a backpack, a vest, a shirt, a jacket, one or more straps, a chest plate, a substrate, a frame, or some combination thereof.

12. The weapon restraint system of claim 10, wherein the chassis comprises a storage container for storing the retractable cable reel, and wherein the storage container comprises an opening through which the cable and/or conduit can pass.

13. The weapon restraint system of claim 1, wherein the conduit prevents the distal end of the cable from retracting through the passageway of the conduit.

14. A method of restraining a weapon, tool, or other object, comprising:

providing a cable having a proximal end and a distal end;

providing a retractable cable reel configured to contain the cable and allow the cable to extend and/or retract relative to the retractable cable reel;

providing a conduit having a passageway extending along at least a portion of the conduit;

positioning the cable such that at least a portion of the cable passes through the passageway of the conduit;

coupling the distal end of the cable to a fastening device; and coupling the fastening device to the weapon, tool, or other object, wherein the retractable cable reel comprises a tension selection mechanism for selecting between a plurality of tension levels, each of the plurality of tension levels corresponding to a category of object.

15. The method of claim 14, further comprising selecting a tension level for the retractable cable reel.

16. The method of claim 15, further comprising positioning the cable and/or conduit such that the cable and/or conduit passes over a shoulder of a user.

17. The method of claim 15, further comprising:

providing a supplemental restraint device having at least one magnet that, when coupled to a magnetic object, cause the supplemental restraint device to support at least a portion of the weapon, tool, or object; and coupling the at least one magnet to the magnetic object such that the supplemental restraint device provides support for at least a portion of the weapon, tool, or object.

* * * * *